United States Patent [19]

Jones

[11] Patent Number: 4,487,619

[45] Date of Patent: Dec. 11, 1984

[54] THERMOELECTRIC TEMPERATURE CONTROLLER FOR LIQUID CHEMICAL BUBBLER CONTAINERS

[75] Inventor: David E. Jones, Pecatonica, Ill.

[73] Assignee: Apache Chemicals, Inc., Seward, Ill.

[21] Appl. No.: 592,836

[22] Filed: Mar. 23, 1984

[51] Int. Cl.[3] ..... F25B 21/02

[52] U.S. Cl. ..... 62/3; 62/177

[58] Field of Search ..... 62/3, 177

[56] References Cited

U.S. PATENT DOCUMENTS 3,174,291 3/1965 Crawford et al. ..... 62/3

3,480,015 11/1969 Gowzalez ..... 62/3 X

OTHER PUBLICATIONS

Apache Model 100 (2nd Version) Prior to 3/23/83.

Apache Model 100 Prior to 3/23/83.

*Primary Examiner*—William E. Wayner

*Attorney, Agent, or Firm*—Vernon J. Pillote

[57] ABSTRACT

A temperature controller for liquid chemical bubbler containers comprising a rectangular cabinet that is separated by an upright partition into a container receiving compartment at one side of the partition and a circuit components compartment at the other side of the partition. A thermoelectric heating and cooling apparatus is mounted in the container receiving compartment above the bottom of the housing and defines a fan chamber therebelow. An axial flow propeller fan is mounted below the heat sink on the thermoelectric device and is arranged to deliver a portion of its air discharge to the heat sink for cooling the same and to deliver another protion of its air discharge to the circuit components compartment for cooling the circuit components therein.

7 Claims, 5 Drawing Figures

THERMOELECTRIC TEMPERATURE CONTROLLER FOR LIQUID CHEMICAL BUBBLER CONTAINERS

BACKGROUND OF THE INVENTION

Various chemical compounds, commonly referred to as dopants, are ultilized in semi-conductor device fabrication. In general, the liquid dopant source material is stored in a bubbler container having a gas inlet and outlet fittings at its top, and a carrier gas is passed in through the inlet and bubbles through the liquid in the bubbler container before passing to the bubbler outlet. The vapor pressure of the liquid dopant varies with temperature and it is necessary to maintain the liquid dopant in the bubbler at a substantially constant preset temperature to control dopant level in the semi-conductor processing furnace.

In a typical installation, the source bubblers are placed on shelves in a gas cabinet at one end of the furnace tubes of the semi-conductor processing furnace. The furnace tubes are heated to a very high temperature, commonly of the order of 1000° C. and the radiant heat from the furnace tubes raises the temperature in the gas cabinet and aggravates the problem of maintaining the liquid dopant source material at a preset temperature. The shelves in the gas cabinet are commonly spaced apart a distance no more than about twelve inches and this limits the overall height of the temperature controller with the bubbler container installed. In addition, the shelves in the gas cabinet have to accommodate a number of other components including flow controllers and tubing which are connected to the ends of the furnace tubes. It is accordingly very desirable to make the temperature controller as small as possible to minimize the shelf space occupied by the temperature controller.

Thermoelectric temperature controllers have heretofore been made for controlling the temperature in the liquid chemical bubbler container. In general, such thermoelectric temperature controllers utilized semi-conductor type thermoelectric devices for either heating or cooling the bubbler container, to establish and maintain the liquid in the container at a preselected temperature. Thermoelectric semi-conductor devices operate on the Peltier effect and produce either heating or cooling depending on the direction of flow of electric current therethrough and the thermoelectric devices are interposed between a heat conducting plate at one side that is disposed in heat conducting relation with the bubbler and a heat sink on the other side. When they are operated to cool the plate, it is necessary to dissipate heat from the heat sink and conversely, when the thermoelectric devices are operated to heat the plate, it is necessary to warm the heat sink. Fans and blowers have been used to pass air over the heat sink to either heat or cool the sink, depending on the mode of operation of the thermoelectric device. The thermoelectric devices use relatively high operating currents and it is also desirable to cool the circuitry for operating thermoelectric devices to prevent overheating of the circuit components and to minimize temperature drift in the circuitry.

In some prior art thermoelectric temperature controllers for bubbler containers, the power supply circuitry for the thermoelectric device was mounted in a separate housing that could be located remote from the housing that contained the thermoelectric device and which received the bubbler container. In such an arrangement, a single fan could not be used to both pass air over the heat sink and to circulate air past the circuit components for cooling the same. In a prior art thermoelectric cooling apparatus manufactured and sold by the assignee of the present application, a single housing was used and separated by an upright partition into a compartment for receiving the bubbler container at one side of the partition and a compartment for receiving the circuit components at the other side of the partition, and a thermoelectric heating and cooling unit below the container receiving compartment. In this prior art temperature control apparatus, a squirrel cage type blower was mounted in the components receiving compartment and was arranged to draw its intake air in through the components compartment and discharge the air over a heat sink of the thermoelectric cooling device. This arrangement was found to be unsatisfactory particularly when the thermoelectric device was operated in a mode to cool the bubbler, since the intake air to the blower was preheated by the circuitry in the components compartment and produced insufficient cooling of the heat sink for the thermoelectric device under some operating conditions. It was also found that re-arranging the air flow to a fan in the components compartment so that air was drawn into the fan over the heat sink of the thermoelectric device and then discharged through the components compartment, did not provide satisfactory operation, particularly when the thermoelectric device was operated in its cooling mode. The intake air to the fan was preheated by the heat sink of the temperature control device and did not provide adequate cooling of the components in the component compartment so that temperature drift and overheating of some components occurred under the adverse temperature conditions in the gas cabinet.

SUMMARY OF THE INVENTION

It is an object of the present invention to overcome the problems encountered with prior thermoelectric temperature controllers for bubbler containers, by providing a thermoelectric temperature controller that utilizes a single axial flow propeller fan which is arranged to pass a portion of its air discharge over the heat sink for the thermoelectric device to dissipate heat or cold from the heat exchanger, and to pass another portion of its discharge air through the components compartment to cool the circuit component for operating the thermoelectric device.

Another object of this invention is to provide a thermoelectric temperature controller for a liquid chemical bubbler container, which is so arranged so that it can be installed along with the bubbler container within the low shelf-to-shelf spacing in the typical gas cabinet, and which yet provides adequate air flow for both cooling the heat sink and the components of the electrical circuit for operating the thermoelectric device.

Yet another object of this invention is to provide a thermoelectric temperature controller for liquid chemical bubbler containers in accordance with the foregoing objects, and which allows installation and removal of a bubbler container from the temperature controller while the temperature controller remains in the shelf.

Accordingly, the present invention provides a thermoelectric temperature controller for liquid chemical bubbler containers of the type having a bottom wall, a generally cylindrical side wall and bubbler gas inlet and outlet fitting on the top wall. The controller comprises a housing of generally rectangular configuration having a bottom wall, front and rear walls and first and second end walls and a top wall. An upright partition extends between the front and rear walls and separates the housing into a container receiving compartment between the partition and the first side wall and an electrical circuit component compartment between the partition and the second side wall, with the housing having an opening in the top wall above the container receiving compartment to allow the inlet and outlet fittings to extend therethrough. A thermally conductive plate is disposed at the lower end of the container receiving compartment and spaced above the bottom wall for supporting the bubbler container in thermally conductive contact therewith. At least one thermoelectric device engages the underside of the thermally conductive plate, and a thermally conductive heat sink engages the underside of the thermoelectric device and has relatively parallel heat conducting fins at its underside extending perpendicular to the front and rear walls. Means including the thermally conductive plate and the heat sink define a fan compartment in the housing below the container receiving compartment and above the bottom wall of the housing. The bottom wall of the housing has air inlet openings therethrough communicating with the fan compartment and the front and rear walls of the housing respectively have front and rear fan compartment air discharge openings therein at a level below the thermally conductive plate and adjacent ends of the fins on the heat sink. The housing has at least one component compartment air discharge opening adjacent the upper end of the circuit component compartment and the partition has a lower opening therethrough at a level below the thermally conductive plate and communicating the fan compartment with the lower end of the circuit component compartment. A propeller fan is mounted in the fan compartment for rotation about an upright blade axis and has a major portion of its blade area closely underlying the fins on the heat sink and another portion of its blade area extending beyond the fins on the heat sink in a direction toward the circuit component compartment so that the fan is arranged to draw air in from the air inlet openings in the bottom wall of the housing and discharge one portion of its output air outwardly against the heat sink for flow between the fins under the heat sink to the front and rear fin compartment air discharge openings, and to discharge another portion of its output air through the lower opening in the partition into the circuit component compartment for flow through the component compartment air discharge outlet. A temperature sensing means senses the temperature in the container and circuit means in the circuit components compartment is connected to the temperature sensing means into the thermoelectric device for regulating operation of the thermoelectric device to establish and maintain a predetermined temperature in the liquid in the container.

Figure 1:
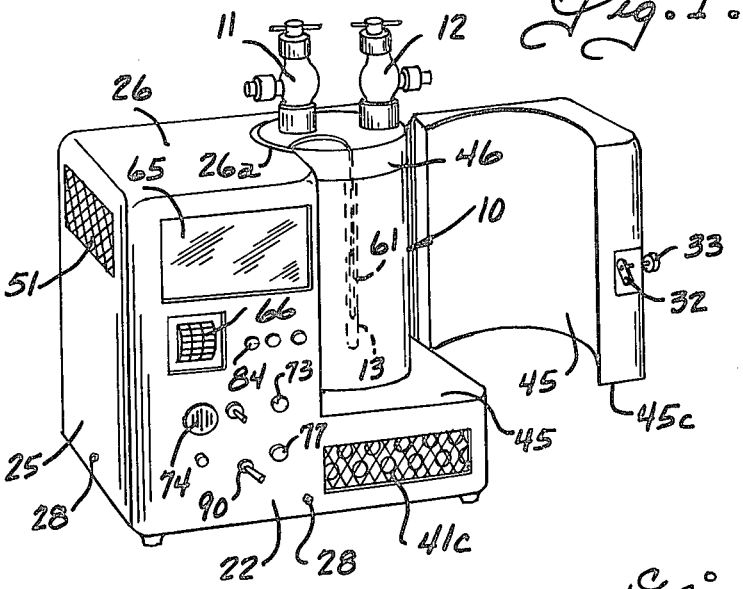
FIG. 1 is a perspective view of a temperature controller for a liquid chemical bubbler container embodying the present invention.

The temperature controller is especially constructed and arranged for use in controlling the temperature of bubbler containers 10 for liquid chemical source materials used in the fabrication of semi-conductor devices. In general, the bubbler containers are of generally cylindrical configuration and have a flat bottom wall, a cylindrical side wall and valved gas inlet and outlet fittings 11 and 12 at the top. In use, a carrier gas is passed into the inlet fitting 11 and down through an internal tube in the bubbler container to the bottom of the bubbler and the carrier gas bubbles up through the liquid chemical source material in the container and becomes saturated before passing through the outlet fitting 12 to the furnace tubes. The vapor pressure of the liquid dopant varies with temperature and it is necessary to maintain the liquid dopant in the bubbler at a preset temperature to control the amount of liquid vapor in the carrier gas. Such bubblers also commonly have a temperature sensing well 13 that extends downwardly into the container from its top and which is arranged to receive a temperature sensing probe. The bubbler containers are commonly formed of quartz or glass, but metal such as stainless steel can be used for some liquid dopants that are not contaminated by contact with such metals. The bubblers come in sizes from 500 to 1500 cc. The diameter of the bubbler varies from about 3.5 inches for the 500 cc bubbler to 5.5 inches for the 1500 cc bubbler, but the different size bubblers have substantially the same height of about 5.1 inches exclusive of the inlet and outlet fittings, and an overall height of about 9.0 inches including the valved inlet and outlet fittings.

The temperature controller has a generally rectangular housing including a bottom wall 21, upstanding front and rear walls 22, 23, first and second end walls 24, 25, and a top wall 26. The housing is preferably formed of metal for heat resistance and durability and the bottom wall is detachably secured to the upstanding walls of the housing as by screws 28 that extend into flanges 21*a* on the bottom wall. Feet 29 are provided on the bottom wall and support the bottom wall spaced above the supporting surface such as shelf S.

An upright partition 31 extends between the front and rear walls 22 and 23 of the housing and separates the housing into a container receiving compartment between the partition and the end wall 24, and an electrical components compartment between the partition and the end wall 25. The forward and rear ends of the partition extend contiguous to the respective front and rear walls at a location substantially medially between the end walls 24 and 25 and, in order to adapt the controller for handling the 1500 cc bubblers as well as the smaller size bubblers, the partition 31 is angulated or bowed intermediate its front and rear edges in a direction toward the end wall 25 so as to increase the cross-section of the container receiving compartment at a location intermediate the front and rear walls to a size somewhat greater than the $5\frac{1}{2}$ inch outer diameter of the 1500 cc bubbler. The usual spacing between the shelves in the gas cabinet is about twelve inches and the housing is made with an overall height substantially less than twelve inches and preferably about nine inches, to allow the valved inlet and outlet fittings 11 and 12 to project above the top wall 26 of the housing. The housing is preferably formed with a generally cubic configuration with a length and width of about nine inches and substantially the same as the height. The top wall 26 of the housing has an opening 26*a* above the container receiving compartment of a diameter slightly larger than the outer diameter of the largest container to be installed in the temperature controller. Portions 22*a* and 24*a* of the front and side wall and the contiguous portions of the top wall of the housing form a generally L-shaped door that is hinged at its rear edge by hinges 30. A latch 32 operated by a knob 33 is provided for locking the door in a closed position.

A thermally conductive plate 35 formed of a metal of high conductivity such as copper, is disposed in the container receiving compartment at a level spaced above the bottom wall 21 and below the top wall 26 so as to support the container in the container receiving compartment with the body of the container at a level below the top wall, and with the valved inlet and outlet fittings 11 and 12 extending above the top wall 26. The body of the bubbler container has a height of about 5.1 inches and the plate is spaced below the top wall 26 a distance of about 6 inches. A heat sink 36 is disposed below the plate 35 and thermoelectric semi-conductor devices 37, herein shown two in number, are interposed between the thermally conductive plate 35 and the heat sink 36 in heat conducting relation therewith. The thermoelectric devices may, for example, be bonded to the plate 35 and heat sink 36 in heat conducting relation therewith by epoxy cement. The heat conductive plate 35 preferably has an outer diameter of 5.5 inches generally corresponding to the diameter of a 1500 cc bubbler. A semi-circular positioning ring 38 is attached to the plate 35 and extends part way therearound to aid in positioning and locating the bubbler on the plate. The heat sink 36 has a generally rectangular configuration with side edges 36*a*, 36*b* and end edges 36*c* and 36*d* and the heat sink has relatively parallel heat conducting fins 36*e* on its underside that extend parallel to the side edges 36*a* and 36*b* to the end edges 36*c* and 36*d*. The heat sink 36 is supported on the bottom wall by brackets 41 each having a top flange 41*a* secured to one end of the heat sink and a bottom flange 41*b* secured to the bottom wall. The brackets 41 extend crosswise of the ends of the heat sink and have large openings 41*c* therethrough extending across the width of the brackets as shown in FIG. 1, and which allow free passage of air through the brackets. Generally rectangular air discharge openings 42 and 43 are formed in the front and rear walls 22 and 23 respectively of the housing at a level below the container support plate 35 and which openings extend substantially the full width of the heat sink to allow discharge of air from the front and rear sides of the heat sink. A protective screen or grid 44 extends across the front and rear discharge opening to inhibit introduction of foreign objects or fingers into the air discharge openings, while allowing free passage of air therethrough. Thermal insulation such as rigid plastic foam 45 is provided in the container receiving compartment and defines a generally cylindrical cavity extending upwardly from the periphery of the container support plate 35 to the top wall 26, to insulate the bubbler 10 from the surrounding atmosphere and to also separate the container receiving compartment above the support plate 35 from a fan compartment below the support plate. The foam insulation is adhesively bonded to the walls of the housing and partition that define the container receiving compartment and is separated along lines 45*a*, 45*b* and 45*c* at the edges of the door so that a portion of the insulation 45 swings with the door while the remaining portion of the insulation 45 is fixed in the housing. As shown in FIG. 1, a pad 46 of resilient foam insulation having an outer diameter corresponding to the cylindrical cavity in the foam 45, is provided for insulating the top of the container, the pad being provided with suitable cutouts to accommodate the inlet and outlet fittings 11, 12.

Figure 3:
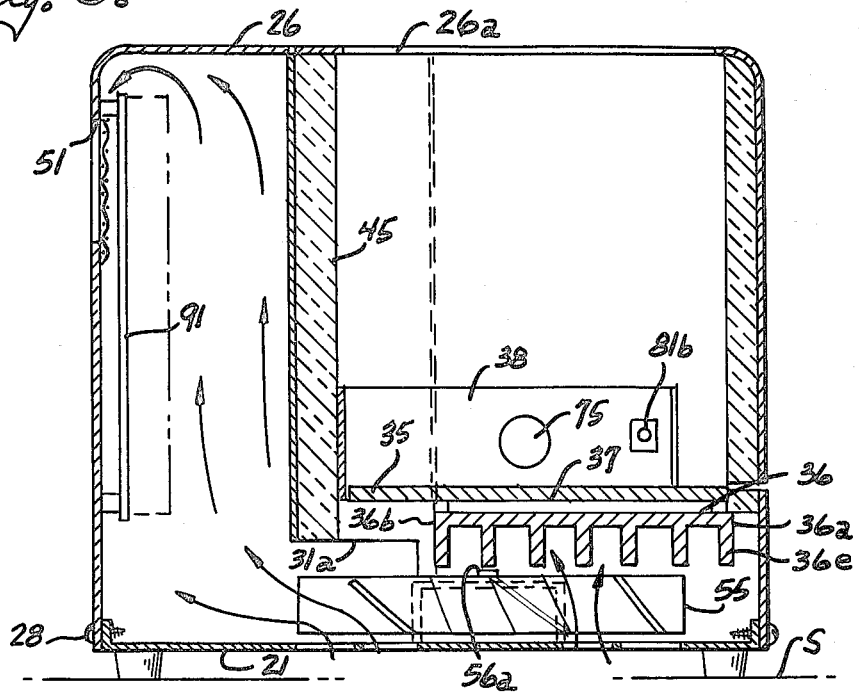
FIG. 3 is a vertical sectional view taken on the plane 3—3 of FIG. 2.
Figure 4:
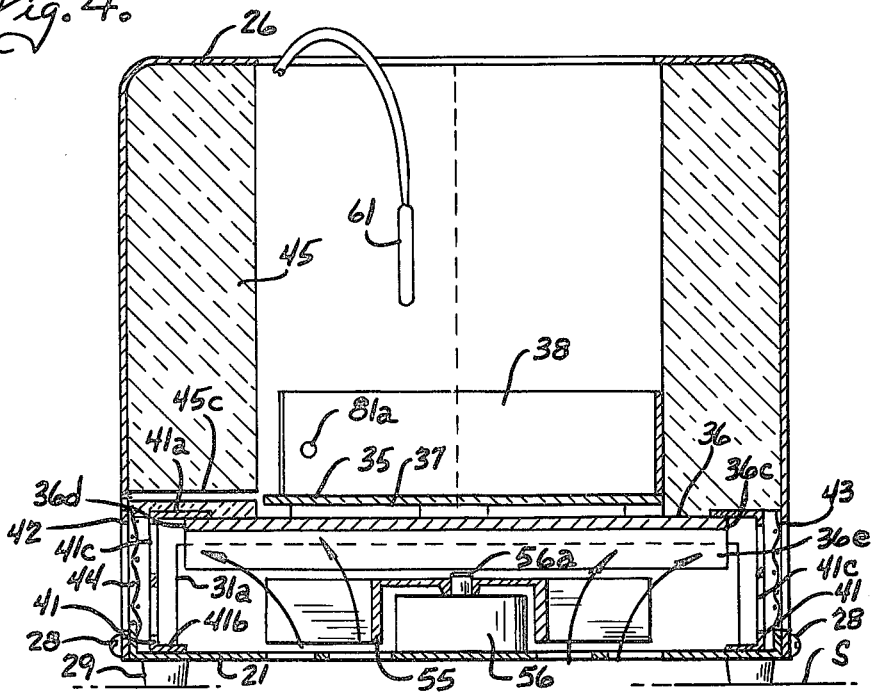
FIG. 4 is a vertical sectional view taken on the plane 4—4 of FIG. 2.

As best shown in FIGS. 3 and 4 the lower portion of the partition 31 is cut away intermediate its front and rear edges, and at a level below the container support plate 35, to provide an enlarged opening 31*a* through the partition and which communicates the fan compartment with the lower portion of the electrical components compartment. At least one upper air outlet opening 51 is provided in the circuit components compartment and is preferably located in the second end wall 25.

Figure 2:
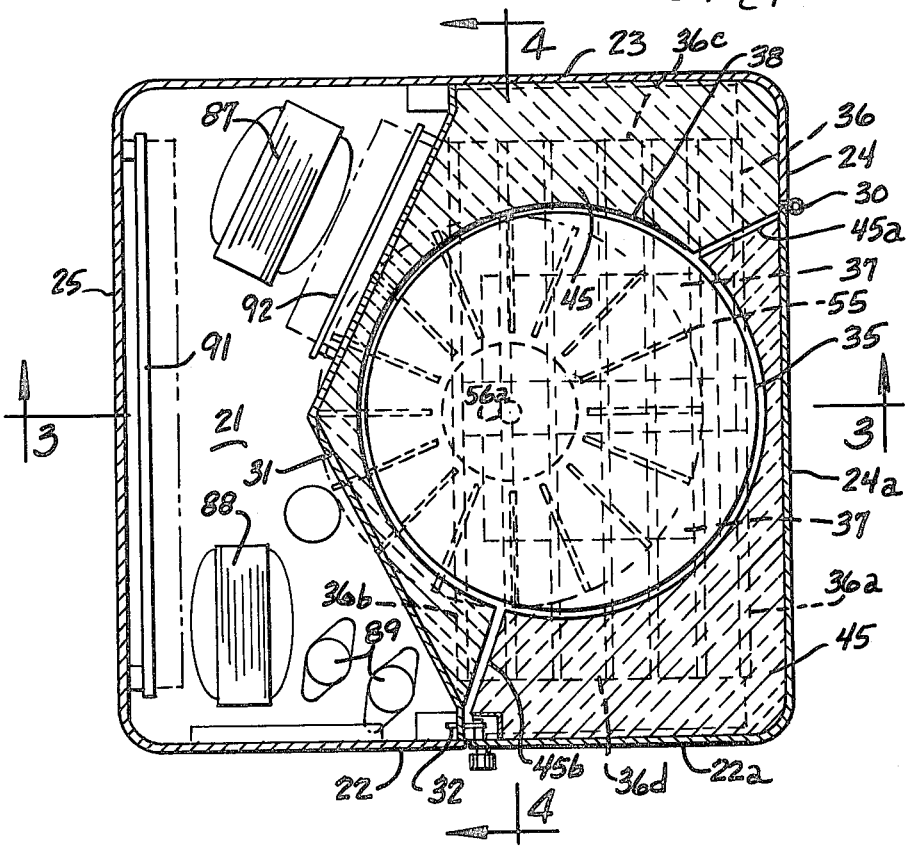
FIG. 2 is a horizontal sectional view through the temperature controller.

An axial flow propeller fan 55 having a drive motor 56, is mounted on the bottom wall 21 below the fins 36*e* on the heat sink 36 and the bottom wall 21 has a plurality of air inlet openings 50 therethrough below the fan blade. The fan blade is arranged so that a major portion of its blade area closely underlies the fins 36*e* on the heat sink 36, with another portion of its blade area extending beyond the fins on the heat sink in a direction toward the components compartment. As best shown in FIGS. 2–4, the axis of the fan shaft 56*a* is located substantially equidistant from the front and rear ends 36*c* and 36*d* of the heat sink, but is offset in a direction crosswise of the heat sink so as to be relatively closer to the edge 36*b* of the heat sink than to the edge 36*a*. The fan blade has an outer diameter which is greater than the transverse width of the heat sink measured between the edges 36*a* and 36*b*, and the fan blade extends beyond the fins at the edge 36*b* of the heat sink, in a direction toward the components compartment. The fan blade is arranged to draw air into the air inlet openings 50 in the bottom wall and to discharge a major portion of its output air upwardly against the heat sink for flow between the fins to the front and rear air discharge openings 42 and 43, and the fan discharges another portion of its output air through the opening 31*a* in the portion 31 into the lower portion of the components compartment for flow upwardly therethrough through the upper air outlet opening 51. The blades 55*a* on the propeller fan extend closely adjacent the underside of the fins 36*e* on the heat sink and the fins function as stator vanes and stop rotary motion of that portion of the air discharged from that portion of the propeller that is immediately below the vane, and to direct the air in relatively opposite directions from the center of the heat sink toward the front and rear discharge openings 42 and 43 in the housing. The air discharged from that portion of the propeller that extends beyond the edge 36*b* of the heat sink, is discharged into the components compartment for cooling the circuit components for operating the theremoelectric device.

Figure 5:
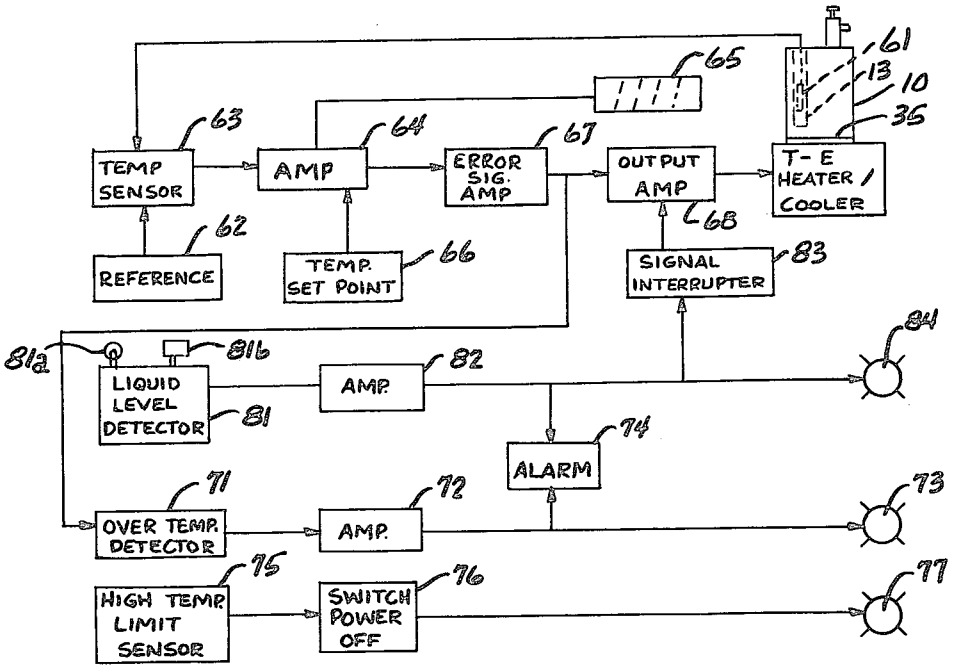
FIG. 5 is a schematic block diagram of the electrical circuit for the temperature controller.

The thermoelectric devices 37 are semi-conductor devices that operate on the Peltier effect and which are operative to effect cooling of the plate 35 affixed to one side while heating the heat sink at the other side, when current is passed in one direction therethrough and which are operative to heat the plate 37 and cool the heat sink 36, when current is passed therethrough in the opposite direction. The thermoelectric devices can therefore be used to either heat or cool the bubbler container 10, as required to establish and maintain a preset temperature. A block diagram of an operating circuit for the temperature controller is illustrated in FIG. 5, it being understood that the various components of the operating circuit except the thermoelectric devices, are located in the components compartment of the housing. As diagrammatically shown in FIG. 5, the source bubbler 10 is positioned on the plate 35 of the thermoelectric heating and cooling apparatus and a temperature sensing probe 61 is inserted into the temperature sensing well 13 to sense the temperature of the source material in the bubbler. An electrical signal from the temperature sensing probe 61 is compared with a signal from a precision reference 62 in a temperature sensing circuit 63 and this circuit feeds a signal correlative with the temperature to a signal amplifier 64. Signal amplifier 64 feeds an electrical signal to a display 65 to provide a visual display of the temperature sensed by the probe 61. A signal from a manually adjustable temperature set point 66 is fed into the signal amplifier which compares the signal from temperature sensor 63 with a signal from the temperature set point 66 and feeds an output signal correlative with the deviation of the measured temperature from the temperature set point to an error signal amplifier 67. An output amplifier 68 is connected to the error signal amplifier 68 and supplies a D.C. output to the thermoelectric device 37 having a polarity correlative with the direction that the sensed temperature deviates from the set point to pass current therethrough in one direction or the other, to either heat or cool the support plate 35 as may be necessary to bring the temperature of the bubbler to the temperature set point.

Provision is also advantageously made for providing a warning signal to the operator in the event the bubbler container is heated a preselected amount in excess of the temperature set point, in order to prevent overheating of the source material. For this purpose, a signal from the error signal amplifier 67 is fed to an over temperature detector circuit 71 which is so arranged that, if the output of the error signal amplifier reaches a value that indicates that the temperature in the bubbler as sensed by the probe 61 is a preselected value for example 5° above the set point temperature, it will supply a signal through a signal amplifier 72 to either a visual display 73 or an audible alarm 74, or both. As a further precaution against overheating of the source material in the bubbler container, a temperature sensor 75 is mounted as on the container locating band 38 at a location to engage the side of the bubbler container adjacent its lower end to sense the temperature of the bubble. As schematically shown in FIG. 5, the temperature sensor 75 is connected to a circuit 76 which is arranged to shut off power to the thermoelectric temperature controller, and to also operate another visual display 77 if the temperature of the bubbler container exceeds a predetermined maximum temperature. Provision is also advantageously made for interrupting operation of the thermoelectric sensor, when the liquid level in the bubbler falls below the preselected minimum. A liquid level detector 81, conveniently of the photoelectric type having a lamp 81*a* and a photoelectric receiver 81*b*, is arranged to sense when the liquid level in the bubbler falls to a preselected minimum, and the liquid level detector feeds a signal to an amplifier 82 that is arranged to operate a signal interrupter 83 to stop operation of the thermoelectric heating and cooling apparatus, and to also actuate a visual display 84.

The aforedescribed circuitry including the circuit components associated therewith are mounted in the circuit components compartment, with some of the components being located on circuit boards shown at 91 and 92, and others such as transformers 87, 88 and output transistors 89 mounted on the bottom wall 21 in the circuit component compartment. As previously described, a portion of the air discharged from the fan is delivered through the opening 31*a* in the partition 31 to the bottom of the electrical components compartment and flows upwardly through the components compartment to the outlet 51, to cool the circuit components in the compartment. The temperature controller is turned on by a manually operable switch 90 and the fan motor 57 is energized continuously while the temperature controller is on.

From the foregoing it is thought that the construction and operation of the thermoelectric cooling apparatus will be readily understood. The axial flow propeller fan is mounted so that a major portion of its blade area underlies the fins on the heat exchanger, while another portion of its blade area extends beyond the side of the heat exchanger in a direction toward the circuit components compartment. Accordingly, a portion of the air discharged from the propeller is delivered to fins on the underside of the heat exchanger for flow toward the front and rear air discharge outlets. Another portion of the air discharged from that portion of the blade area that extends laterally of the heat sink, is delivered to the circuit components compartment to cool the circuit components as it flows to the air discharge outlet 51. With this arrangement, a single fan is effective to dissipate the heat and/or cold from the heat sink for the thermoelectric device and to also cool the components in the circuit components compartment.

The axial flow propeller fan requires only a very small space below the heat sink so that the overall height of the thermoelectric controller can be maintained sufficiently low, for example of the order of nine inches, to enable installation of the temperature controller in gas cabinets where shelves are spaced apart a distance of only about twelve inches. Further, the arrangement of the door in the front and one end of the housing allows installation and removal of the bubbler container either from the front or end of the housing without requiring removal of the temperature controller from the shelf. The temperature controller is also very compact to occupy a minimum of shelf space in the gas cabinet.

The embodiments of the invention in which an exclusive property or privilege is claimed are defined as follows:

1. A thermoelectric temperature controller for a liquid chemical bubbler container of the type having a bottom wall, a generally cylindrical side wall and bubbler gas inlet and outlet fittings in the top wall, the controller comprising, a housing of generally rectangular configuration having a bottom wall, front and rear walls, first and second end walls, and a top wall, an upright partition extending between the front and rear walls and separating the housing into a container receiving compartment between the partition and said first side wall and an electrical circuit component compartment between the partition and said second side wall, the housing having an opening in the top wall above the container receiving compartment to allow the inlet and outlet fittings to extend therethrough, a thermally conductive plate spaced above the bottom wall and disposed at the lower end of the container receiving compartment for supporting the bubbler container in thermally conductive contact therewith, at least one thermoelectric device engaging the underside of the thermally conductive plate, a thermally conductive heat sink engaging the underside of the thermoelectric device and having relatively parallel heat conducting fins at its underside extending perpendicular to the front and rear walls, means including said heat conductive plate and said heat sink defining a fan compartment in the housing below the container receiving compartment and above the bottom wall of the housing, the bottom wall of the housing having air inlet openings therethrough communicating with the fan compartment, the front and rear walls of the housing respectively having front and rear fan compartment air discharge openings therein at a level below the thermally conductive plate and adjacent opposite ends of the fins on the heat sink, the housing having at least one component compartment air discharge opening adjacent the upper end of the circuit component compartment, the partition having a lower opening therethrough below the thermally conductive plate and communicating said fan compartment with the lower end of said circuit component compartment, a propeller fan mounted in the fan compartment for rotation about an upright blade axis and having a major portion of its blade area closely underlying the fins on the heat sink and another portion of its blade area extending beyond the fins on the heat sink in a direction toward the circuit component compartment, the fan being arranged to draw air in from the air inlet openings in the bottom wall of the housing and discharge one portion of the output air upwardly against the heat sink for flow between the fins and under the heat sink to the front and rear fan compartment air discharge opening and discharge another portion of its output air through the lower opening in the partition into the circuit component compartment for flow through the component compartment air discharge outlet, temperature sensing means for sensing the temperature of the liquid in the container, and circuit means in said circuit components compartment and connected to said temperature sensing means and to said thermoelectric device for regulating operation of the thermoelectric device to establish and maintain a predetermined temperature in the liquid in the container.

2. A thermoelectric temperature controller according to claim 1 wherein the heat sink has a rectangular configuration with front and rear end edges disposed adjacent the respective front and rear fan compartment air discharge openings and first and second side edges paralleling the fins, the first side edge of the heat sink being disposed adjacent the first side wall of the housing, the axis of the propeller fan being disposed below said heat sink at a location that is substantially medially between said front and rear end edges of the heat sink and relatively closer to said second side edge than to said first side edge.

3. A thermoelectric temperature controller according to claim 2 wherein said fan has an outer diameter greater than the spacing between said first and second side edges of the heat sink.

4. A thermoelectric temperature controller according to claim 1 wherein portions of said front wall and said first side wall form a generally L-shaped door hinged at one edge to allow access to the container receiving compartment from the front and one side of the housing.

5. A thermoelectric temperature controller according to claim 1 wherein said partition has front and rear ends disposed contiguous to the respective front and rear side walls at locations substantially medially between the first and second end walls.

6. A thermoelectric temperature controller according to claim 5 wherein said partition is bowed intermediate said front and rear ends in a direction toward said second side wall.

7. A thermoelectric temperature controller according to claim 2 wherein said partition has front and rear ends disposed contiguous to the respective front and rear side walls at locations substantially medially between the first and second end walls.

* * * * *